US005454169A

United States Patent [19]

Keller

[11] Patent Number: 5,454,169

[45] Date of Patent: Oct. 3, 1995

[54] BOW SIGHT AND METHOD

[76] Inventor: Charles R. Keller, 5628 Wrightsboro Rd., Grovetown, Ga. 30813

[21] Appl. No.: 221,667

[22] Filed: Apr. 1, 1994

[51] Int. Cl.[6] ..... F41G 1/467

[52] U.S. Cl. ..... 33/265; 124/87

[58] Field of Search ..... 33/265, 261; 124/87

[56] References Cited

U.S. PATENT DOCUMENTS 4,120,096 10/1978 Keller ..... 33/265
4,685,217 8/1987 Shader ..... 33/265
5,040,300 8/1991 Sheffield ..... 33/265
5,367,780 11/1994 Savage ..... 33/265
5,388,336 2/1995 Pomaville ..... 33/265

*Primary Examiner*—Christopher W. Fulton
*Attorney, Agent, or Firm*—Ralph Bailey

[57] ABSTRACT

A back sight is illustrated for alignment with a front sight on a bow for use in compensating for improper torsional positioning of the bow having an arcuate housing (A) which includes a loop forming a frame for the back sight which is adjustably carried by a mounting bracket (B) upon the bow and accommodating a cross hair (C) for facilitating proper torsional adjustment of the bow in the hand of the archer when aligned with a compatible front sight.

3 Claims, 3 Drawing Sheets

BOW SIGHT AND METHOD

BACKGROUND OF THE INVENTION

This invention relates to an improvement upon the invention of U.S. Pat. No. 4,120,096 and more specifically to back sight useful in aiming a bow and arrow by indicating alignment achieved by twisting the bow to the right or to the left by the bow hand of the archer.

The bow sight of the above patent has proven to be very effective in achieving proper alignment in the horizontal plane and more particularly in the vertical plane wherein a sighting member which preferably includes at least one bead is balanced for pivotal movement about a horizontal transverse axis. This pendulum movement automatically determines the proper elevation of the bow depending upon the distance to the target.

Bow sights have a common disadvantage in that provision is not made to insure proper gripping of the bow by the bow hand so that the position of the bow about a longitudinal upright axis is not always the same and not always such as to accommodate proper alignment of the bow and arrow in a horizontal plane.

Because of this deficiency, while the attitude of the bow and arrow in the vertical plane may be accurately adjusted or aimed and while gross adjustments in the horizontal plane may be readily achieved, the exertion of a torsional force by the bow hand of the archer will bring about misalignment of the flight of the arrow to the right or to the left which will result in inaccuracies in aiming.

SUMMARY OF THE INVENTION

Accordingly, it is an important object of this invention to provide a back bow sight which is especially adapted for use with the bow sight of the above patent but which may be utilized with front bow sights generally available on the market.

Another important object of the invention is the provision of a back sight for use on a bow to permit proper aiming so as to compensate for the torsional force which may be inadvertently exerted by the archer when gripping the bow.

Another important object of the invention is to provide a back bow sight having an arcuate generally oval shaped housing carried by a mounting bracket and which positions a cross member such as a cross hair which may be aligned with the oval housing of the front sight of the above patent so as not to obscure the target and so as to permit proper axial alignment of the bow overcoming torsional forces inadvertently applied thereto by the archer when aiming.

An important object of the invention includes the method of sighting the target for aiming the bow and arrow utilizing a proper alignment of the front and rear sights and achieving automatic indications of vertical adjustment in the attitude of the bow through the balanced pivotal member which automatically provides proper compensating for distance while a rear sight is aligned to overcome any torsional misalignment of the bow.

This invention contemplates a back or rear sight which is especially useful with the pendulum front sight of U.S. Pat. No. 4,120,096, the disclosure of which is incorporated herein by reference. This is because complete vertical and horizontal sighting indications, as well as compensation for distance, are thus made available to the archer.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a back sight for alignment with a front sight for a bow having a grip for the bow hand of an archer for aiming an arrow in shooting position in the bow. An arcuate housing A includes a loop forming a frame for the back sight. A mounting bracket B is carried by the bow in the sighting area positioning the frame for alignment with the front bow sight when aiming the bow and an arrow to be shot therefrom. A cross member C is carried by the frame for alignment in a horizontal plane with the front bow sight. Thus, the cross member of the back sight is aligned with the front bow sight and with a bow string and arrow by movement of the bow in a vertical plane and with adjustment in the horizontal plane being accomplished by twisting the bow hand to the right or to the left carrying the bow in a turning motion to bring about alignment with a target. The front sight includes a compatible front loop D carrying a sighting member such as a bead E which is carried on a mounting which is balanced for pivotal movement about a horizontal transverse axis for automatically gaging the proper elevation of the bow depending upon the distance to the target.

Figure 1:
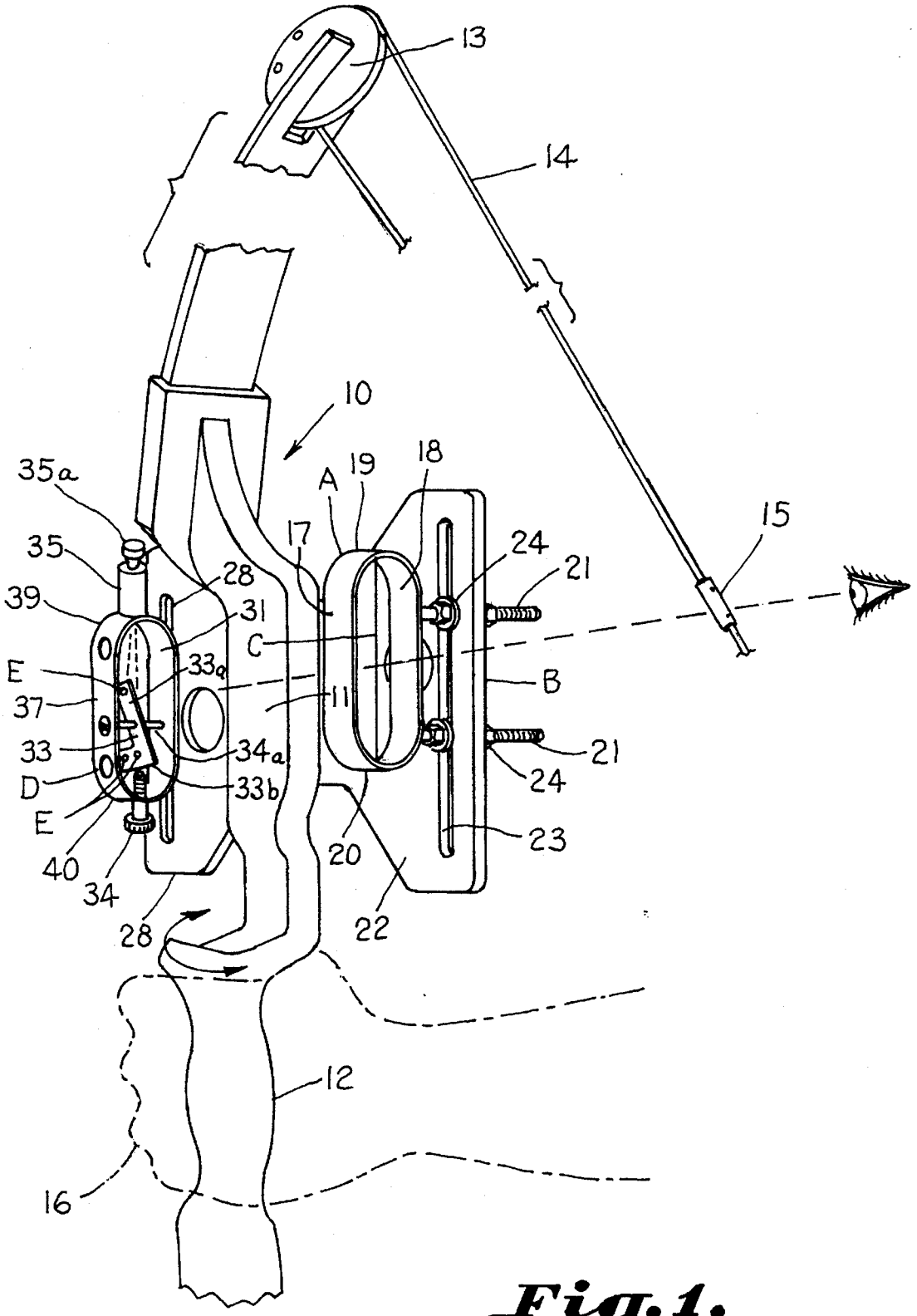
FIG. 1 is a perspective view illustrating the manner of aligning the back sight hereof with a front sight constructed in accordance with the invention.
Figure 2:
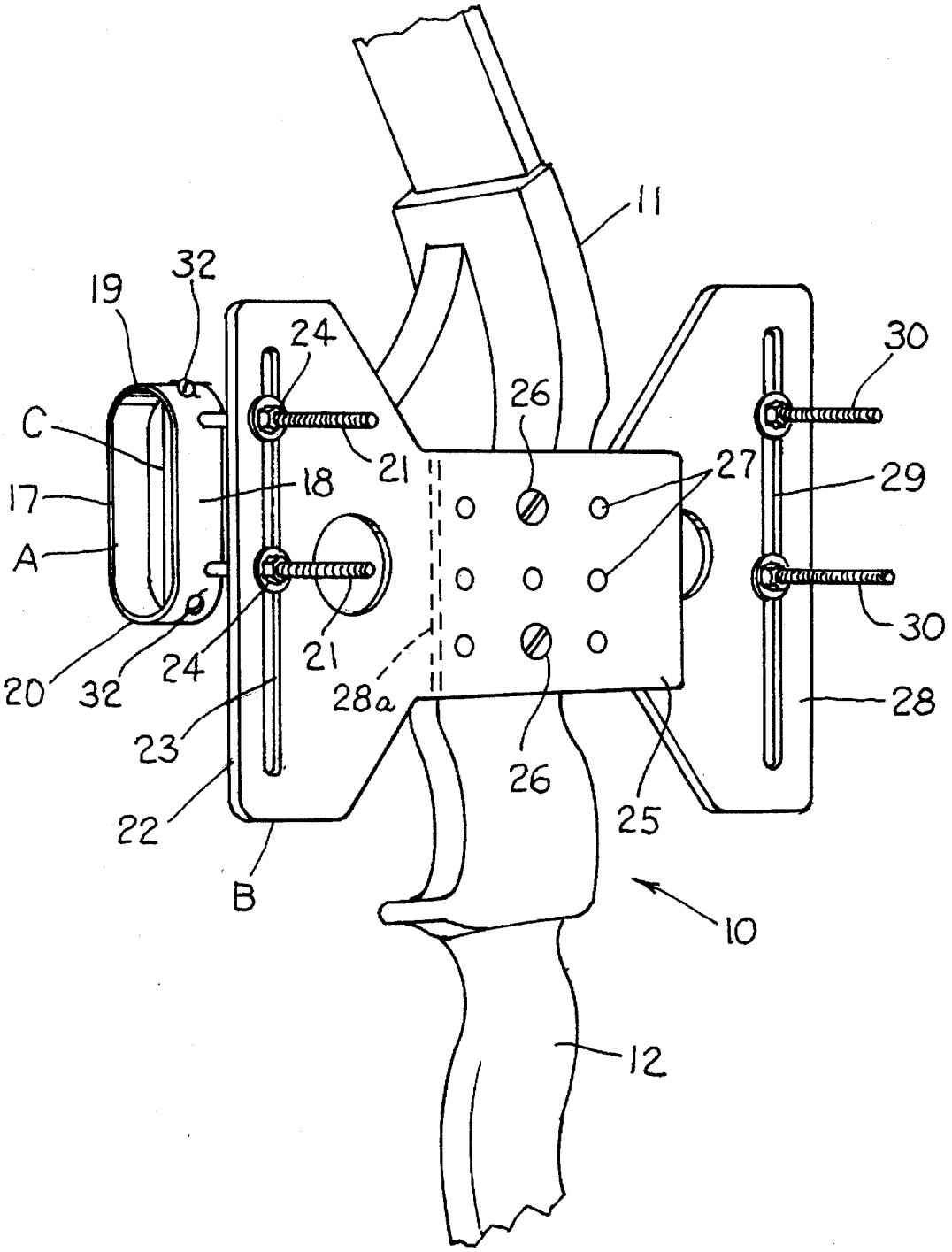
FIG. 2 is a perspective view looking toward the rear of the back sight illustrated in FIG. 1 further illustrating the back sight and the mounting thereof in adjustable relation to the front sight and to the bow.
Figure 3:
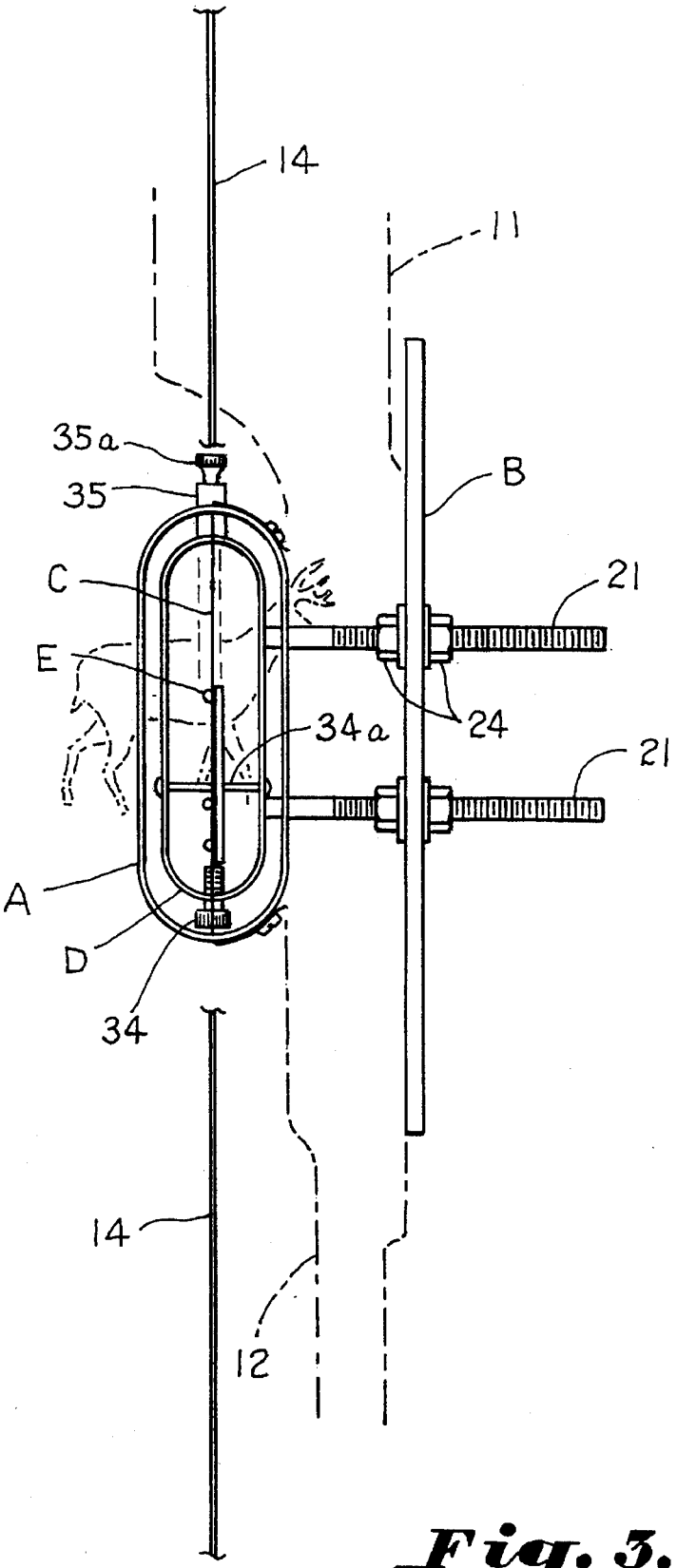
FIG. 3 is an enlarged elevation with front and rear sights in alignment with a target which in this case is game in the form of a deer.

Referring more particularly to FIGS. 1 and 2, a compound bow is illustrated having an intermediate section broadly designated at 10. The intermediate section includes an offset member 11 and a hand gripping portion 12. In FIG. 1 an upper end of the bow is illustrated as having the usual pulley 13 which accommodates the bow string 14 and the peep sight 15 carried thereby. The hand of the archer is illustrated in broken lines at 16 while the eye of the archer is illustrated as viewing the front and rear sights through the peep sight 15 during the aiming process.

The back sight includes an arcuate housing A having a loop which is preferably in the shape of an elongated vertical oval. The oval loop has substantially vertical parallel sides 17 and 18 and curved upper and lower circular segments 19 and 20 respectively. The side 18 is illustrated as carrying parallel threaded members 21 extending outwardly thereof for positioning in a mounting portion 22 of the bracket B passing through a vertical slot 23 therein. The housing A is thus fixed in adjustable vertical position by tightening the nuts 24.

Referring to FIG. 2, it will be observed that the bracket B which includes the mounting portion 22 has a horizontal extension 25 which is adjustably positioned upon the offset portion 11 of the bow by securement of the screws 26 to provide for adjustment in a horizontal plane by selecting desired holes 27 in the extension 25. A similarly configured bracket 28 has a vertical slot 29 for adjustably accommodating threaded mounting members 30 positioning an oval housing D of the front sight. The bracket 28 has an extension 28a which underlies the extension 25 of the bracket B and is similarly adjustable.

The drawings illustrate the provision of a cross member C in the form of a cross hair provided by a vertical wire secured by suitable fasteners 32 so that the wire extends through and vertically across the oval housing A.

The oval housing D of the front pendulum sight which is secured by the vertical side 31 to the bracket 28 is thus positioned vertically on the bow and carries a sighting member including at least one bead E. The sighting member in addition to the bead includes a mounting 33 which is balanced by a forward extension 33a and a base portion 33b. The base portion is illustrated as carrying two additional beads E which may come into play depending upon the pivotal position of the mounting or sighting member 33 reflecting the distance from the archer from the target. The mounting members 31 and 37 carry the sighting member 33 upon a horizontal transverse axis provided by the pin 34.

A threaded thumb screw 34 is provided for adjustably engaging the base 33b so as to position the mounting 33 in a fixed position within the housing D at all times except when the bow is in use in order to prevent damage to the front sight mechanism. Additionally, a light 35, which may be actuated by the plunger 35*a* to direct a beam upon one of the beads E which is in position for sighting in alignment with the target, is positioned upon an upper segment 39 of the oval housing D of the front sight. The thumb screw 34 is on the lower segment 40 while the pin 34*a* is supported in an intermediate position of the vertical sides 37 and 31.

It is thus seen that a back sight is provided which is especially adaptable for use with a pivotally mounted bead which is balanced for automatically determining distance adjustments in sighting within a complementary oval housing having vertical cross hair to permit torsional adjustments to be made by the hand of the archer upon the bow to compensate for improper horizontal alignment resulting from faulty positioning of the bar in the bow hand of the archer.

While a preferred embodiment of the invention has been described using specific terms, such description is for illustrative purposes only, and it is to be understood that changes and variations may be made without departing from the spirit or scope of the following claims.

What is claimed is:

1. A back sight for alignment with a front sight for a bow having a grip for the bow hand of an archer comprising:

an arcuate support and a sighting member carried on a balanced mounting pivotal about a horizontal transverse axis and being capable of aiding an archer in sighting on a target from both an elevated and level shooting position on said front sight, an arcuate housing including a loop forming a frame for the back sight;

said arcuate housing being substantially matched with said arcuate support;

said loop comprising a closed generally oval element having substantially vertical parallel sides with curved upper and lower segments;

a mounting bracket rigidly connected to the bow in the sighting area positioning said frame for alignment with the front bow sight when aiming the bow and an arrow to be shot therefrom; and a cross member carried by said frame for alignment in a horizontal plane with the front bow sight;

whereby said cross member of said back sight is aligned with said front bow sight and with a bow string and arrow by movement of the bow in a vertical plane and with adjustment in said horizontal plane being accomplished by moving the bow hand to the right or to the left carrying the bow in a twisting motion to bring about alignment with a target.

2. The structure set forth in claim 1 wherein the cross member is a vertical wire extending lengthwise across said frame.

3. The method of aiming a bow and arrow utilizing a back sight for alignment with a front sight on a bow having a grip for the bow hand of an archer, said front sight including an arcuate support and a sighting member carried on a balanced mounting pivotal about a horizontal transverse axis and being capable of aiding an archer in sighting on a target from both an elevated and level shooting position, comprising the steps of:

providing an arcuate housing including a loop forming a frame for the back sight substantially matched with said arcuate support wherein said loop comprises a closed generally oval element having substantially vertical parallel sides with curved upper and lower segments;

rigidly connecting said frame to said bow;

positioning said frame for alignment with the arcuate support of the front bow sight when aiming the bow and an arrow to be shot therefrom; and positioning a cross member on said frame for alignment in a horizontal plane with the sighting member of the front bow sight; and aligning said cross member of said back sight with said front bow sight and with a bow string and arrow by moving the bow in a vertical plane and with adjustment in said horizontal plane by moving the bow hand to the right or to the left carrying the bow in a twisting motion to bring about alignment with a target.

* * * * *